US005297470A

United States Patent [19]

Niederstadt et al.

[11] Patent Number: 5,297,470

[45] Date of Patent: Mar. 29, 1994

[54] PNEUMATIC ROTARY DRIVE

[75] Inventors: Jörg Niederstadt, Schramberg; Ralf Huber, Brigachtal, both of Fed. Rep. of Germany

[73] Assignee: Mannesmann Aktiengesellschaft, Dusseldorf, Fed. Rep. of Germany

[21] Appl. No.: 994,418

[22] Filed: Dec. 21, 1992

[30] Foreign Application Priority Data

Dec. 20, 1991 [DE] Fed. Rep. of Germany ..... 4142844

[51] Int. Cl.[5] ..... F01B 11/02

[52] U.S. Cl. ..... 92/85 R; 92/89; 92/92; 92/120

[58] Field of Search ..... 92/85 R, 89, 90, 91, 92/92, 120

[56] References Cited

U.S. PATENT DOCUMENTS 3,229,590 1/1966 Huska ..... 92/120
4,756,237 7/1988 Shishkin et al. ..... 92/91
4,838,148 6/1989 Denker ..... 92/90
5,224,412 7/1993 Goedecke et al. ..... 92/89

FOREIGN PATENT DOCUMENTS 0640050 12/1978 U.S.S.R. ..... 92/90

*Primary Examiner*—Thomas E. Denion
*Attorney, Agent, or Firm*—Cohen, Pontani, Lieberman, Pavane

[57] ABSTRACT

A pneumatic rotary drive includes a housing which is connectable to a pressure medium source and is closed in a pressure medium-tight manner by plane covers. A rotatable shaft extends out of the housing through at least one of the covers. A belt which is in engagement with the shaft is arranged within the housing so as to form moveable pressure chambers. At least one guide body arranged within the housing is surrounded by the belt. At least one of the guide bodies is provided with a spring element for resiliently adjusting the effective circumference of the at least one guide body.

7 Claims, 2 Drawing Sheets

PNEUMATIC ROTARY DRIVE

BACKGROUND OF THE INVENTION

1. Field of the Invention

The present invention relates to a pneumatic rotary drive.

2. Description of the Related Art

U.S. Pat. No. 4,838,148 discloses a pneumatic rotary drive in which a ring-shaped belt surrounds a stationary cylinder-shaped body, so that the belt assumes a kidney shape and forms pressure chambers. Depending on where pressure is applied, this kidney-shaped circular belt travels to one side or to the other side. At the respective end stop of the belt, the pressure chamber volume to which pressure medium is admitted is at a maximum and the pressure chamber volume to be vented is at a minimum, i.e. zero. In other words, the belt makes contact on one side with the cylinder-shaped body over half the circumference of the body and, thus, further yielding of the belt under the application of pressure can no longer occur. The movement of the belt under the application of pressure is transmitted to a shaft by means of toothings arranged on the outside of the belt. This known pneumatic rotary drive has the disadvantage that during operation at high angular velocities, a jerky and sudden deceleration of the rotary movement occurs at each stop. This has a disadvantageous effect on the support of the moveable elements and on the toothing itself. Moreover, because of the extremely high sudden tensile load acting on the belt, a shorter service life of the belt itself must be expected. This rotary drive utilizes a single stationary cylinder-shaped body or guide body.

U.S. application Ser. No. 07/861,228, U.S. Pat. No. 5,224,412 proposes a rotary drive with two guide bodies which are surrounded by a belt and are in operative connection with a shaft which extends to the outside. Depending on the respective end position assumed by the belt, the belt makes almost complete contact with the periphery of one of the guide bodies or with the periphery of the other of the guide bodies. In this rotary drive, a sudden deceleration also takes place when approaching the end stops.

SUMMARY OF THE INVENTION

Therefore, it is the primary object of the present invention to provide simple mechanical means for dampening the approach of the respective end stop positions in various rotary drives.

In accordance with the present invention, a pneumatic rotary drive includes a housing which can be connected to a pressure medium source. The housing is closed in a pressure medium-tight manner by plane covers. A rotatable shaft extends out of the housing through at least one of the covers. A belt forming movable pressure medium chambers is arranged within the housing and is in operative connection with the shaft. The belt is guided within the housing so as to surround at least one guide body. At least one of the guide bodies has a spring element for resiliently changing the effective circumference of the at least one guide body by interacting with the belt in one end stop position thereof.

Since at least one of the guide bodies is provided with a spring element which resiliently changes the effective circumference or diameter of the guide body, the present invention provides the advantage that an effective dampening action is provided when the belt approaches the end stop region.

The dampening action is provided in an advantageously simple manner by spring elements according to the present invention which are of simple construction and can even be used for mounting on already existing rotary drives. The spring elements have a convex curvature in the area where the belt assumes the end stop position, so that a homogeneous force or energy absorption by the spring element is ensured. The spring element may be of an elastomer. The spring action is obtained in an advantageously simple manner by providing the spring element with undersides which are essentially without curvature and are placed without force against the outer contours of the guide bodies if no force is applied to the spring elements.

Each spring element has an umbrella-shaped portion with a convexly curved outer side. Once the belt approaches the end stop position, it initially makes contact with the convexly curved outer side of the umbrella-shaped portion of the spring element and, when additional pressure is applied and the end stop position is almost reached, an elastic deformation of the spring element takes place, such that the underside of the spring element which is uncurved when no force is applied becomes curved and tightly contacts the circumferential contour of the guide body. Thus, the spring energy is represented by the range between the position in which the underside of the spring element is still uncurved and the position in which the underside makes contact with the guide body. Along this range, kinetic energy is removed from the system and is converted into potential spring energy, so that a sudden reaching of the end stop position is prevented and the end stop position is approached in a decelerated manner.

In accordance with another advantageous feature of the present invention, pressure medium ducts are arranged in that portion of the guide body in which the underside of the spring element rests against the outer contour thereof. When the underside of the spring element rests tightly against the guide body, the pressure medium ducts are closed. Depending on the manner of actuation, the pressure medium ducts can be connected to a ventilating line through one or the other guide body, so that in the end stop position, the belt closes the ventilation through the spring elements and a pressure cushion is built as a result, wherein the pressure cushion causes an additional dampening.

The remarkably simple arrangement according to the present invention provides an extremely efficient dampening for rotary drives in the end positions. The arrangement is particularly suitable for rotary drives which realize relatively high forces while carrying out large angles of rotation, usually more than 360°, and require dampening of high kinetic energies at the end positions.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DESCRIPTION OF THE PREFERRED EMBODIMENT

Figure 1:
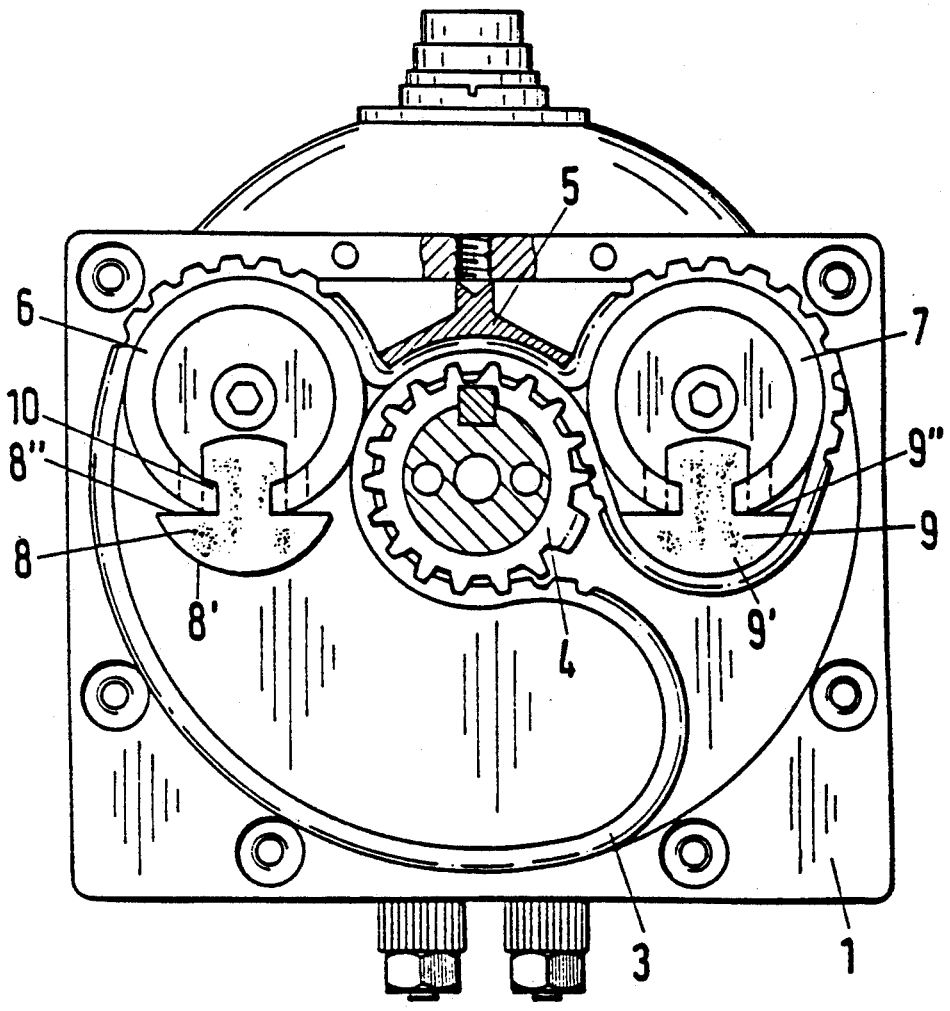
FIG. 1 is a schematic sectional view of a belt-driven rotary drive in an initial position.

FIG. 1 of the drawings shows a rotary drive in which a ring-shaped closed belt 3 is guided within a housing 1. The belt 3 is guided around an essentially central rotary shaft 4 which makes the rotary movement available at the outside. The belt 3 is guided within the housing 1 around two guide bodies 6, 7. The belt 3 surrounds the shaft 4 not completely but only partially. In addition, a pressing element 5 is provided which presses two belt sections against each other in such a way that the two pressure chambers on the left and on the right are insulated from each other in a pressure medium-tight manner.

In the initial position of the rotary drive or of the belt shown in FIG. 1, the belt is displaced in such a way that the kidney-shaped pressure chamber formed by the belt on the left hand side almost has its greatest possible volume. On the right hand side as seen in FIG. 1, the belt 3 is near the end position, but still in a relatively unloaded state of the elastomer spring 9. This is apparent from the fact that the underside 9" of the elastomer spring 9 on the right hand side is still essentially uncurved and essentially extends as a tangent at the circumferential contour of the guide body 7.

Figure 2:
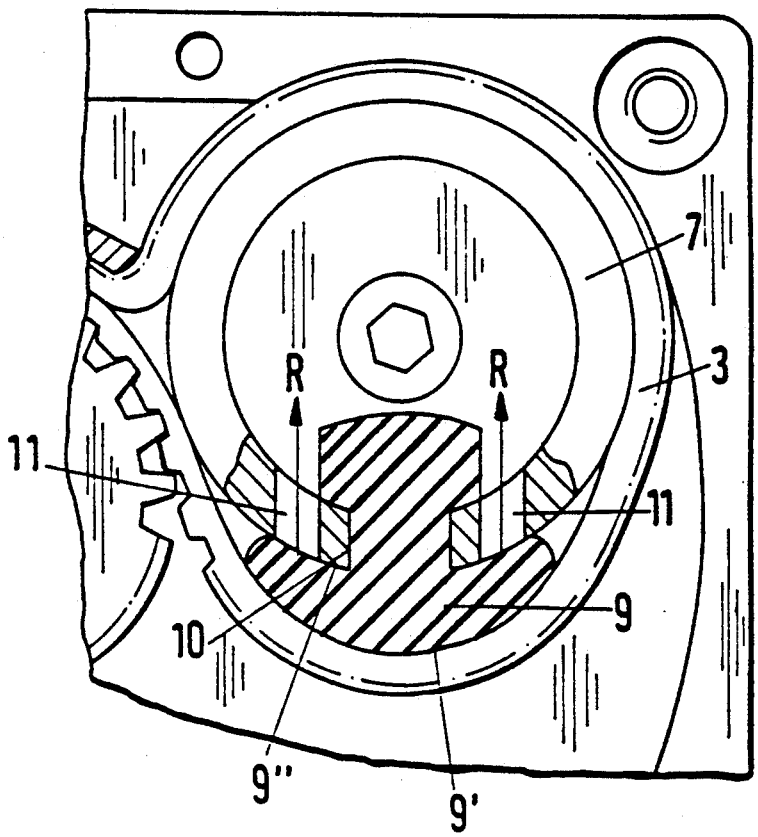
FIG. 2 shows, on a larger scale, a detail of the spring element of the rotary drive of FIG. 1 in an end stop position.

The detail of FIG. 2 of the drawing shows the rotary drive after the end stop position has been reached. In this position, the underside 9" of the umbrella-shaped portion of the spring element 9 tightly rests against the circumferential contour of the guide body 7 and the belt 3 is subjected to corresponding tensile load. In the end stop position shown in FIG. 2, the energy of the rotary drive is converted into potential spring energy.

As FIG. 2 further shows, the guide body 7 is provided with pressure medium ducts 11 which are in communication with ventilation R. When the underside 9" of the umbrella-shaped portion of the spring element 9 is still essentially uncurved, as shown in FIG. 1, the pressure chamber volume formed by the corresponding portion of the belt is still connected to ventilation. However, once the end stop position is reached and the underside 9" of the spring element 9 rests against the outer contour of the guide body 7, the pressure medium ducts 11 are closed and the remaining pressure chamber volume is disconnected from the ventilation R. This additionally results in a compressed air cushion which additionally assists in dampening at the end stop position.

The arrangement described above provides with remarkably simple means an extremely effective end position dampening of pneumatic rotary drives.

In accordance with the present invention, it is also conceivable to provide spring elements which divide the guide body along the diameter thereof, so that the parts thereof are spaced from each other by the spring elements and only in the end stop position the tensile forces of the belt result in an approach or pressing of both guide body parts against the spring forces. Also in this case, the effective diameter of the guide body is resiliently adjustable.

As further shown in FIG. 2, the guide body 7 has a slot 10 and a web portion of the spring element 9 is received by the slot 10 for mounting the spring element.

In accordance with another feature, the position of at least one of the guide bodies may be adjustable.

The arrangement according to the present invention can be used in rotary drives of the type disclosed by U.S. Pat. No. 4,838,148, i.e. rotary drives having a single guide body, as well as in rotary drives having two guide bodies, of the type disclosed by U.S. patent application Ser. No. 07/861,228.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

What is claimed is:

1. A pneumatic rotary drive comprising a housing connected to a pressure medium source, the housing having plane covers for closing the housing in a pressure medium-tight manner, a rotatable shaft mounted so as to extend out of the housing through at least one of the covers, a belt mounted within the housing so as to be in engagement with the shaft and forming movable pressure medium chambers, at least one guide body mounted within the housing and being surrounded by the belt, and at least one spring element mounted on the at least one guide body, such that an effective circumference of the at least one guide body is resiliently adjustable by the belt acting on the spring element in an end stop position of the belt on the at least one guide body.

2. The pneumatic rotary drive according to claim 1, comprising two guide bodies each having a spring element, the spring elements being mounted on outer contour portions of the guide bodies which face the pressure chambers formed by the belt.

3. The pneumatic rotary drive according to claim 2, wherein each guide body has a slot and each spring element has an umbrella-shape portion and a web portion, and wherein the web portions of the spring elements are lockable in the slots of the guide body, the umbrella-shape portions having convex outer sides, the umbrella-shape portions with the convex outer sides extending into the pressure chambers.

4. The pneumatic rotary drive according to claim 3, wherein the spring elements are of an elastomer material, each umbrella-shaped portion having an essentially uncurved underside when no force is applied to the spring element, wherein the under side is forced against the outer contour of the guide body when the belt is in the end stop position.

5. The pneumatic rotary drive according to claim 4, wherein each guide body has pressure medium ducts arranged in the outer contour portion facing the umbrella-shaped portion of the spring element, wherein the pressure medium ducts are closed when the umbrella-shaped portion of the spring element is pressed against the outer contour portion in the end stop position of the belt.

6. The pneumatic rotary drive according to claim 5, wherein the guide bodies are cylindrical bodies.

7. The pneumatic rotary drive according to claim 2, wherein at least one of the guide bodies is mounted in the housing so as to be adjustable.

* * * * *